US006250961B1

(12) United States Patent
Boiret et al.

(10) Patent No.: US 6,250,961 B1
(45) Date of Patent: Jun. 26, 2001

(54) HERMETIC CONNECTION ASSEMBLY

(75) Inventors: Gerard Boiret, Yvre l'Eveque; Serge Auger, Bouer; Olivier Bourgeois, Monce en Belin, all of (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/391,832

(22) Filed: Sep. 8, 1999

(30) Foreign Application Priority Data

Sep. 9, 1998 (FR) ..... 98 11399

(51) Int. Cl.[7] ..... H01R 13/40
(52) U.S. Cl. ..... 439/587; 439/660
(58) Field of Search ..... 439/587, 589, 439/274, 275, 654, 935, 851, 660

(56) References Cited

U.S. PATENT DOCUMENTS 3,673,546 * 6/1972 Green et al. ..... 439/172
4,653,839 * 3/1987 Powell ..... 439/660
5,598,132 * 1/1997 Stabile ..... 439/188
5,772,457 6/1998 Cairns ..... 439/201
5,785,544 * 7/1998 Linden et al. ..... 439/278

FOREIGN PATENT DOCUMENTS 0 209 255 A1 1/1987 (EP) .
1 594 183 7/1981 (GB) .

OTHER PUBLICATIONS

French Report Report, 4/99.

* cited by examiner

*Primary Examiner*—Tulsidas Patel
(74) *Attorney, Agent, or Firm*—Perman & Green, LLP

(57) ABSTRACT

In order to create a hermetic connection assembly (1, 2) with a female insert (2), the insert provided with double-female (5, 27) receptacles (4) is placed on a hermetic male connector (1). In order to assure a good electrical connection, clips or sockets (7, 26), preferably truncated, are positioned inside the receptacles, taking support and assuring an electrical contact, on the one hand, with an inner wall of a receptacle and on the other hand, with an outer wall of a pin (8) when such a pin is inserted in the receptacle.

13 Claims, 1 Drawing Sheet

HERMETIC CONNECTION ASSEMBLY

BACKGROUND OF THE INVENTION

Figure 1B:
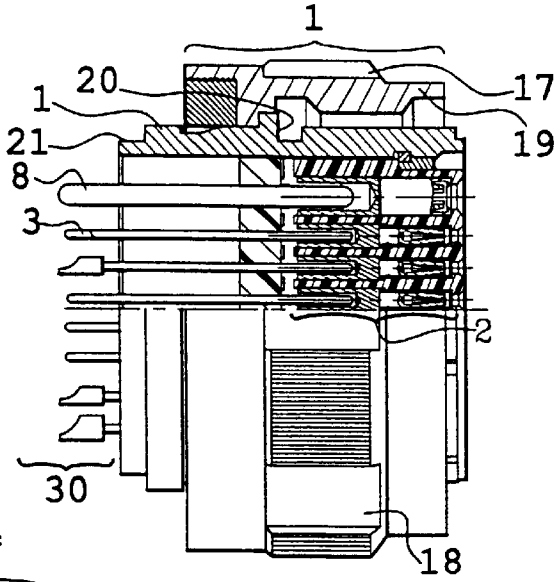

The present invention has for an object a hermetic connection assembly that can be used principally with severe environmental temperature and pressure stresses. It more particularly finds application in the field of marine geophysics, both for control of electric equipment to assist in drilling, arranged on the ocean floor, as well as for the feed, piloting and charting of measurements conducted by measuring devices lowered into drilled holes or also arranged on the ocean floor. While being designed for electrical connections, the invention remains applicable to optical or fluid connections.

The stresses that connection assemblies according to the invention must support are notably a temperature greater than 180° and they are subjected to pressure greater than several tens of MegaPascals. With regard to tightness, one distinguishes between sealed devices and hermetic devices. Hermetic devices must be suitable for environments such as those cited above, while sealed devices only satisfy stresses one or more orders of magnitude below those cited above. Hermeticity is necessary, notably when one disconnects a connector, so that aggressive agents, [such as] sea water [or] pollutant gas, cannot attack the core of a cable through the connector, or even short-circuit strands of this cable.

In a known manner, only connectors of the male type are hermetic. For simplification, such connectors only have solid, non-fragile contact parts. They are in practice made by melting a powder, or microbeads, of glass, which assures the "setting" of the metallic male pins (solid) in a pierced insulating support, for example, of ceramic, as well as providing hermeticity along the passage of the pin in the support. The solid character of the pins permits them to support a fabrication method that would require a temperature resistance capable of reaching up to 900° (high temperature of glass melting). The ceramic support is itself mounted in a connector casing, for example of stainless steel, during this melting step. This mode of embodiment with glass bonding confers a high quality of hermeticity to the connection assembly. No fluid is then able to penetrate through the support or through the interstices between the support and the set pins, or between the support and the casing.

In contrast, female connection assemblies can only be qualified as sealed assemblies. In fact, these female assemblies must have hollow components to receive the male pins of a complementary connector. These hollow components do not have the same rigidity as the male pins and must in contrast show a certain flexibility. This flexibility is not of a nature to permit the hollow components to resist the stresses that are exerted on them during the melting of glass. As a result, the method of "setting" used must be different, and the hermeticity qualities are inferior.

Moreover, it is not possible to render these hollow components more rigid, since such connection assemblies can have from one to several hundred connection points. The space that they occupy must therefore be as small as possible, and devices designed for hermeticity must occupy the smallest possible space. As a result, for reasons of miniaturization, the hollow components are close to one another and since they are thin, they are not very resistant.

In order to resolve these problems of herneticity, in the invention, a connection assembly is made, which has, on the one hand, a hermetic male connector, and, on the other hand, an electrical insert "two times female", preferably of the sealed type and of very small size. This "two times female" insert comes to be positioned on the protuberant pins of the male connector via the first receptacle access that it has. Then, by other access places of these receptacles, and face to face with the first, it offers a female connection solution. In this manner, the connector will become elongated. This is not disruptive, since this elongation is developed in the direction of a cable to be coupled. In contrast, this solution has for an essential effect to procure qualities of hermeticity (that of the male connector) without increasing the diameter of the female connection assembly made, while minimizing the overall length of this assembly. It therefore remains totally compatible with existing connectors. The hermeticity of the male connector thus leads to the hermeticity of the assembly.

In the invention, the female insert is characteristic, since it has a set of double-access receptacles. In a preferred variant, one of these accesses of the receptacle is provided with an inner elastic conductor tube or clip. A male connector pin is then inserted inside the tube in the receptacle.

The invention therefore has for an object a female connection assembly, characterized in that it has a hermetic male connector provided with protuberant pins, and a double female insert placed in the connector, this insert having a set of double-access conductor receptacles.

DETAILED DESCRIPTION OF THE INVENTION

Figure 1A:
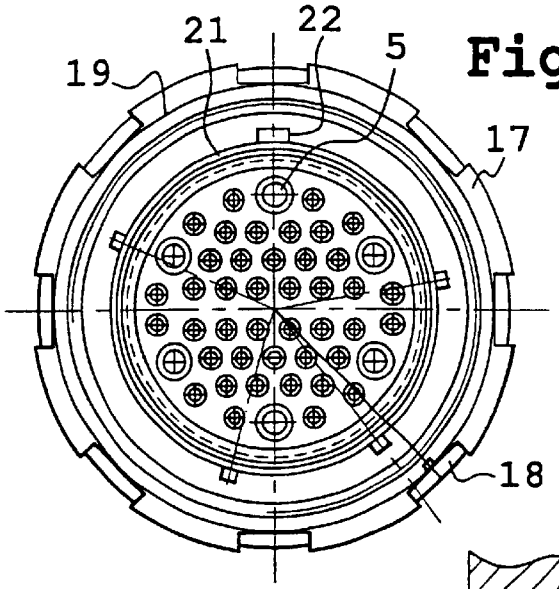
Figure 2:
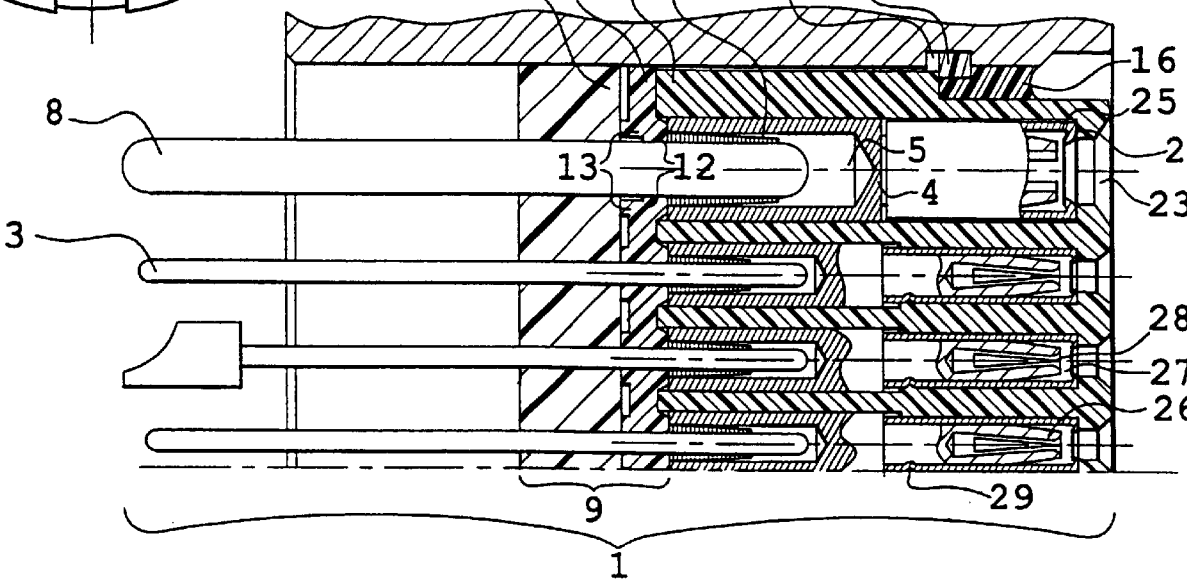

The invention will be better understood upon reading the description that follows and examination of the figures that accompany it. The latter are only presented by way of example and do not limit the invention. The figures show:

FIGS. 1*a* to 1*b*: corresponding representations of a face view and a profile view, this latter also comprising an exploded view of a connection assembly according to the invention;

FIG 2: an enlargement of the exploded view of FIG. 1*b*.

DETAILED DESCRIPTION OF THE INVENTION

FIGS. 1*a* and 1*b* show a connection assembly according to the invention. This assembly comprises, in a male connector 1, a female insert 2. In one example, male connector 1 comprises a casing of stainless steel. Female insert 2 is designed to receive one or more pins such as 3 of male connector 1. We have shown these pins as 16 or 22 gauge, but other calibers are, of course, conceivable. In a preferred manner, the connection assembly will have, inside insert 2, means for being connected to many pins 3, for example one or several hundred pins. The connection assembly shown has an outer connection interface visible in FIG. 1*a* and presented on the right-hand part of FIGS. 1*b* and 2. This connection assembly is designed, moreover, to be coupled, internally, to a circuit or a cable, preferably multistrand, arriving from the other side, on the left-hand side in FIGS. 1*b* and 2.

Insert 2 has many double-access female contacts or receptacles, and in all cases at least one double-access female contacts or receptacle member such member as 4 (FIG. 2). Receptacle member 4 has a first access of female form to receive pin 3. For an electrical application, receptacle member 4 is made of a conductor material. It has a second access situated on the other side of the receptacle relative to the first access, on the right of FIG. 2. This second access is designed to be electrically (or optically) coupled to a pin of another male connector, not shown, which would come to be coupled to the assembly shown of the female connection of the invention.

For the first access, receptacle 4 has a cavity 5. In one example, cavity 5 only opens up on a single side, towards the left. It would therefore be conceivable that receptacle 4 is only one element of a hollow tube, beginning from the protuberant part of pin 3, to form a female engagement by a second access, from the other side of the tube.

In a preferred example, receptacle 4 is of circular cylindrical shape. It is, for example, notably obtained by partially piercing a solid tube, of copper or bronze in one example, or possibly by molding. As a result, a receptacle 4 has a bottom partition to separate the two access places. In an optical application, the bottom partition would be pierced. Receptacle 4 is mounted in connector 1 by means of a sheath 6. Sheath 6 is electrically insulating. It is, for example, of hard rubber or plastic. In practice, sheath 6 only serves for the placement of different receptacles 4 in connector 1. Insert 2 is thus principally made up of receptacles 4 and sheath 6. Preferably, receptacles 4 are mounted in a sealed manner in connector 1. For this purposes, receptacles 4 are mounted in a sealed manner in sheath 6.

According to an improvement of the invention, a receptacle 4 is provided with an elastic conductor tube or clip 7 in electrical relation with the walls of receptacle 4. Due to its elasticity, clip 7 is supported on, and enters into electrical contact with an inner wall of receptacle 4. When the insert is mounted in connector 1, a metal pin 8 is inserted into cavity 5 of receptacle 4. Clip 7 is also in electrical contact with the outer wall of pin 8. For this purpose, clip 7 has a slightly truncated form (several degrees of angle). As a variant, clip 7 can be made from a cylindrical section in which longitudinal slots are made on either side and in which the wing pieces thus created are slightly twisted toward the outside at one end and toward the inside at the other end. In the cone created, the wider base is preferably situated on the side of the opening of cavity 5. Possibly, clip 7 is attached in receptacle 4 by its greater outer diameter in order to prevent it from sliding. As can be seen in FIG. 2, when the pin 8 is inserted into the cavity 5, the clip 7 is wedged in the cavity 5, preventing the clip from sliding in the cavity, and effecting contact between pin 8 and receptacle member 4.

The hermeticity of the connection assembly is preferably assured by a plug 9 supported on an inner wall of connector 1, on the one hand, and on the outer walls of pins 3 and 8, on the other hand. In a preferred embodiment, plug 9 has a support 10 and an interfacial cover 11 for compression or reaction. Support 10 is, for example, made of ceramic. It is set into the casing of connector 1 and on pins 8 and 3 by melting of glass powder, as explained above. Compression cover 11 is then placed on support 10. It comprises an assembly of face-to-face perforations corresponding to cavities 5 of receptacles 4 made in the connection assembly. These perforations are equal in number and size corresponding to the gauges used each time.

Cover 11 is in the form of a thick sheet, round if the connection assembly is round, elastic and provided with perforations as well as ring-shaped reliefs 12 and 13 situated on either side of this sheet at the site of each perforation. Ring-shaped reliefs 12 are designed to be interleaved in the holes made in sheath 6, and through which receptacles 4 were introduced. Ring-shaped reliefs 12 are designed to be supported on the upper round edges of receptacles 4. Ring-shaped reliefs 13 are designed to take support on support 10, around each pin. Cover 11 can notably have a reference marking for the pins.

This assembly is mounted in the following manner. Receptacles 4 are introduced into sheath 6, in the holes that correspond to their gauge. Before or after this introduction, clips 7 are positioned inside cavities 5. Then sheath 6 thus equipped is placed in connector 1. Connector 1 has previously been provided with support 10 and compression cover 11. This latter is placed in connector 1 with its perforations facing receptacles 4. Support 10 could also be forced into connector 1 in such a way that it assures a hermetic seal with the casing of connector 1 by its edges. By means of reliefs 13 and 12, the tight bond of connector 1 to cover 11 is transmitted to receptacle 4 on the one hand and, possibly, to sheath 6 on the other hand.

Sheath 6 is not a conductive material, like support 10 and compression cover 11. Preferably, insert 2 is introduced into connector 1 from the right. After positioning and compression, insert 2, with sheath 6, is set [tightened], notably by means of an elastic washer 14 which is supported on a shoulder 15 of connector 1. The assembly is sealed by means of a plug or peripheral sealing joint 16.

The length of receptacles 4 is adjusted to the length of the casing of connector 1. In the example shown, the edges of the second female access planes of the connection assembly of the invention are flush with the end of this casing. In practice, it is permissible for the length of the connector to be increased by the length of receptacles 4. This elongation is not disruptive, since it is oriented in the direction of the cables to be coupled and it is also minimized due to the fact that the insert is chosen to be of short length. It can also be limited, if necessary, by choosing short protuberance lengths of pins 3 and 8.

Cover 11 has round perforations, placed facing each receptacle, and whose diameter is narrower than the outer diameter of clip 7. In practice, clip 7, truncated, is placed with its point directed toward the bottom of cavity 5. The greater outer diameter of clip 7 therefore faces and can come into contact with reliefs 12 of cover 11. The diameter of the latter reliefs is narrower than the greatest outer diameter [of the clip] and prevents extraction. These perforations nevertheless have a diameter that is greater than or equal to an inner diameter of the clip necessary to allow pins 3 and 8 to pass.

Connector 1, here mechanically male, is provided with a handling wheel 17 notably having notches 18 to permit gripping a setting [tightening] tool. Wheel 17 has in its front part, toward the right part of FIG. 1*b*, an anchoring device 19 designed to permit the interleaving of the connection assembly of the invention in a complementary corresponding device. For example, anchoring device 19 has threads coming to be engaged in a hollow male screw forming the periphery of a facing complementary connector. Wheel 17, which can freely turn relative to connector 1, due to the effect of the attraction exerted by anchoring device 19, drives connector 1 by means of a circular push button 20 by which it takes support on this connector 1.

Receptacles 4 are mounted in sheath 6, for example, by molding, with holes corresponding to the sites where receptacles 4 are placed. These holes will comprise at a rear end 23 circular tracks 24 of narrower diameter than these holes, and against which the rear bases of receptacles 4 will take support. These receptacles comprise in their rear base, as a second access, female conductor tips 25 forming protection tubes for the coupling sockets, to which these tips will be electrically coupled. In FIG. 2, sockets 26 are shown in cavities 27 of tips 25 forming the second access.

A male connector is connected into the female connection assembly of the invention in the following manner. A pin of this male connector is introduced through a hole 23 of the sheath into a female tip 25. Inside this tip, the pin penetrates through an opening 28 into a conductive socket 26. The electrical connection between the pin and socket 26 is obtained by the hollow ogival shape of these sockets 26. These ogival shapes are, for example, made from tube elements in which longitudinal cuts permit forming wing pieces, pressed back toward the axis of the tube. By its outer wall a socket 26 enters into contact with protruding parts 29 oriented toward the inside of cavity 27 of the female tip.

The electrical connection of tips 25 to cavities 5 in receptacles 4 is obtained preferably by making these receptacles in a single-block manner each time. It will therefore be noted that it is not necessary for the gauges of tips 25 to be the same as those of facing cavities 5. In fact, it is possible, within the tolerance limits of space occupied and distribution, to provide different gauges, so as to create, for example, from a single hermetic male connector, different types of female connection assemblies.

Connector 1 has a male cylindrical outgrowth 21, the furthest toward the back, which is designed to be imbedded in a circuit or in the covering of a cable to be coupled to the connector. The cable strands or the connections of this circuit are, for example, soldered to the left ends of pins 8 and 3. Once the connection of all the cable strands is made, one can mold, from rear part 30 of connector 1, at the left of FIGS. 1*b* and 2, a flexible hermetic material that is also bound to an outer covering of the cable thus electrically coupled to the connection assembly. This molding can easily have hermetic qualities since it will also be of single-block form.

By the effect of anchoring device 19, and possibly by a joint placed at the bottom of the cavity that receives outgrowth 21, connector 1 can be hermetically insulated, in its bond with a circuit or a cable, from the surrounding space. The mounting additionally sealed by inserts 4 in connector 1 does not change this hermeticity. Sizing grooves 22 can permit placing the two connectors in an anticipated correspondence one against the other during joining of two complementary connectors.

What is claimed is:

1. A female connection assembly comprising:

a hermetic male connector provided with a hermetic section having protuberant pins, the male connector defining a chamber therein; and at least one female insert (2) placed in the chamber of the male connector (1), the at least one female insert having a set of conductor receptacle members (4) located therein, wherein at least one of the conductor receptacle members has a double access for inserting pin contacts into the at least one conductor receptacle member; and wherein a first access of the double access of the at least one receptacle member has an elastic conductor clip, for effecting contact with a protuberant pin received in the first access of the at least one receptacle member, the elastic conductor clip having a tapered wedge shape tapering inwards from a base of the conductor clip positioned at an opening of the at least one receptacle member, and the conductor clip being wedged between the pin and receptacle member to effect contact between the pin and receptacle member when the protruding pin is inserted into the first access.

2. An assembly according to claim 1, wherein the clip is truncated.

3. Assembly according to claim 1, wherein the clip has a cut-out cylinder to form contact wing pieces.

4. An assembly according to claim 1, wherein the clip is attached in the at least one receptacle member to prevent the clip from sliding.

5. An assembly according to claim 1, wherein the hermetic section has a plug (9) hermetically supported on an inner wall of the connector and on the pins of the connector.

6. An assembly according to claim 5, wherein in that plug (9) has a support (10) "set" onto the pins and on the connector by glass bonds.

7. An assembly according to claim 1, wherein a second access of the double access of the at least one receptacle member has a raised portion (29) to maintain a reception socket in the receptacle member.

8. An assembly according to claim 1, wherein the insert has a sheath (6) with hole, one end of which has a winding track (24) to maintain the receptacle member in the insert.

9. An assembly according to claim 1, wherein the at least one receptacle member has a partition to separate the first access from another access of the double access into the at least one receptacle member.

10. An assembly according to claim 1, wherein the at least one conducting receptacle member is a one piece member.

11. An assembly according to claim 2, wherein the elastic conductor clip is disposed in the first access with the base at an entry into the first access.

12. An assembly according to claim 1, wherein the male connector has a predetermined longitudinal length which defines an overall longitudinal length of the female connection assembly, and the at least one conductor receptacle member has a longitudinal length adjusted so that when the female insert is located in the chamber of the male connector, the predetermined longitudinal length of the male connector and the overall longitudinal length of the connection assembly remain unchanged.

13. A hermetic female connector comprising:

an outer shell;

a plug section disposed within the outer shell and forming hermetic contact with the outer shell, the plug section having a pin contact hermetically held in and protruding from the plug section; and a female insert disposed within the outer shell, the female insert having a female contact therein with a double access for inserting two pin contacts into the female contact, the pin contact in the plug section being received into one access of the double access of the female contact;

wherein the plug section has a relief portion biased against the female contact.

* * * * *